United States Patent [19]

Eadie et al.

[11] 4,211,583

[45] Jul. 8, 1980

[54] CARD-CLOTHING WIRE

[75] Inventors: Brian K. M. Eadie, Johnstone; William H. C. Parker, Glasgow, both of Scotland

[73] Assignee: Eadie Bros. & Co. Limited, Paisley, Scotland

[21] Appl. No.: 944,025

[22] Filed: Sep. 20, 1978

[30] Foreign Application Priority Data

Oct. 11, 1977 [GB] United Kingdom ..... 42209/77

[51] Int. Cl.[2] ..... D01G 15/84

[52] U.S. Cl. ..... 148/6.35; 148/31.5; 427/249; 427/252; 19/144

[58] Field of Search ..... 19/114; 51/242; 140/100, 97; 148/6.35; 427/249, 252

[56] References Cited

U.S. PATENT DOCUMENTS

| | | | |
|---|---|---|---|
| 2,816,048 | 12/1957 | Galmiche | 427/253 |
| 3,066,044 | 11/1962 | Samuel | 427/253 |
| 3,387,338 | 6/1968 | Kanai et al. | 19/114 |
| 3,833,968 | 9/1974 | Arai et al. | 19/114 |

*Primary Examiner*—Ralph S. Kendall

*Attorney, Agent, or Firm*—Norris & Bateman

[57] ABSTRACT

Card-clothing wire is manufactured for use on rollers in textile fibre processing machines. The wire is formed into a helical coil, with the teeth projecting radially from the rib of the wire, in the same manner as in the condition of use on the roller, and while in this helical coiled formation is subjected to a high temperature chromium diffusion process to produce a surface layer enriched with chromium, producing a surface hardness in excess of 1500 HV as measured on the Vickers hardness scale. Although the surface is well able to withstand the abrasive action of the fibres in use, it is not subjected to cracking, because of the precoiling of the wire before it is subjected to the diffusion process.

4 Claims, No Drawings

CARD-CLOTHING WIRE

Card-clothing as used in the textile industry is of two basic kinds. In the flexible foundation kind, a large number of wire staples is secured in a flexible sheet foundation with the points protruding to provide the card-clothing teeth. In the metallic wire type, teeth are formed on one edge of a wire of special cross-section, rather like a saw, so that when the wire is coiled around a roller or cylinder, the teeth point radially outwards. For some purposes the card-clothing consists of separate pin projecting from the roller. Such pins may be mounted in a flexible foundation, so that the clothing is a special type of flexible foundation card-clothing or sometimes they are let into holes formed in the roller itself—as happens in certain types of opening roller used in open end spinning apparatus. All these types of card-clothing are included in the expression "card-clothing" as used hereinafter.

Now the card-clothing teeth are subjected to wear due to abrasion by the fibres and/or impurities in the fibrous mass, during the carding or opening process. This wear is a significant factor in reducing the effective life of the card-clothing, particularly when the combing action is severe and the fibres are of an abrasive nature. (Some synthetic fibres are very abrasive—for example one type of fibre contains titanium dioxide, which is highly abrasive on the steel of the card-clothing wires.)

In an attempt to meet this problem of wear, there has been a tendency for many years now, to increase the hardness of the steel from which the card-clothing wire is made. Thus, carbon steel of 0.40% to 0.45% carbon content was generally in use for this purpose some years ago, but steels containing 0.65% to 0.80% carbon are now frequently used, and it has been proposed to use alloy steels (tungsten or vanadium) in some instances. Various heat treatments have also been used, but in the case of metallic wire type card-clothing (which is frequently used in high wear situations) it is not possible to harden the root of the wire, because it must remain capable of bending when coiled on the roller or cylinder. This places limitations on the effectiveness of the hardening of the teeth themselves.

The present invention is concerned with meeting this problem of relatively rapid wearing of card-clothing wire, and although it has been tested with metallic wire type card-clothing it would apparently be useful in relation to flexible foundation or pin type card-clothing.

According to this invention card-clothing wire of carbon steel has its surface subjected to a high temperature chromium diffusion process such that a surface layer of the wire is enriched with chromium to an extent which provides the surface of the wire with a hardness in excess of 1500 HV (i.e. 1500 $Kg/mm^2$) as measured on the Vickers hardness scale. It has been found that card-clothing wire made in accordance with the invention has a much longer working life than card-clothing made by previously known methods. As card-clothing wire wears, its edges become roughened and the carding power decreases. In some applications, it is possible to reduce the speed of the carding or opening operation to accommodate this reduction in carding power, but in most modern situations, this is not economically practicable, and there is a fall-off in the quality of the yarn being produced. Once wear sets in, one rapidly arrives at the condition where the quality of the yarn is unacceptable. Now with heat treated carbon steel card-clothing wire, it is only possible to attain hardness of around 800 HV, although over 1000 HV has been claimed for alloy steel card-clothing wire. However, it has been found there is a dramatic increase in the wear resistance if the chromising surface treatment of the invention is used which is apparently more than could have been expected from merely increasing the hardness by conventional methods, and this produces a great increase in wear resistance, which has been noted.

Preferably, the surface treatment is carried out by use of a gaseous compound of chromium, the wire being subjected to this compound at a high temperature (that is a temperature in excess of 900° C.), so that the chromium vapour combines with the carbon in the steel to produce a chromium carbide surface layer having a very high degree of hardness.

According to another preferred feature, metallic wire type card-clothing is coiled into a helical formation similar to that it is required to adopt in use, and is then subject to the chromium diffusion process whilst in the coiled state so that the hard coating is not subjected to bending strains during subsequent application of the wire to the roller or cylinder.

The invention has been found to be of particular advantage in relation to the card-clothing use on the opening roller of an openend spinning apparatus, and such an application, will now be described by way of example only.

The opening roller of an open end spinning apparatus is carried by a shaft mounted in bearings, and during operation of the apparatus is required to rotate at a high speed. Around the periphery of the roller, there is a helical coil of metallic wire type card-clothing, this card-clothing being secured to the roller either throughout its length, or at the ends. Our co-pending application Ser. No. 31,472 filed Apr. 19, 1979, describes a special type of opening roller for use in open end spinning apparatus, and the present invention can be used with this special type of opening roller, or with a more conventional opening roller.

The metallic wire type card-clothing has the usual root portion and toothed portion, the root portion being thicker than the toothed portion. The card-clothing wire is formed by known methods in carbon steel of high carbon content (1% or more) and whilst it is in the coiled condition, it is subjected to a chromising process.

For this purpose, the coiled wire is placed in a furnace having a temperature in excess of 900° C., the atmosphere inside the furnace consisting of a gaseous compound of chromium. The chromium vapour combines with carbon in a boundary layer of the steel, to give a surface zone of chromium carbides, which provides the very hard wear resisting surface characteristic required in the wire. As a result of the chromising process, the boundary layer of the wire has an average chromium content of about 70%, the thickness of this boundary layer being limited to a maximum of 0.0125 millimeters. Tests have shown, that as a result of the creation of this hard carbide boundary layer, the surface hardness of the card-clothing wire is approximately 1700 HV, and the underlying metal can be hardened during a subsequent heat treatment operation.

Now clearly, with a boundary layer having a hardness of approximately 1700 HV, there is great resistance to wearing of the significant edges of the teeth of the card-clothing as a result of abrasion by the fibres during the opening operation.

After removal of the coil from the chromising furnace, the coil can then be subjected to heat treatment of a coventional nature, for the purpose of hardening the carbon steel of the card-clothing wire, following which, the coil can be slid endwise on to the opening roller.

It is to be understood, that the chromising process can be used on metallic wire type card-clothing, without necessarily pre-coiling that wire, although problems could then arise, if the wire has to be bent around a roller of relatively small diameter. Such chromised wire may for example however be used on the cylinder or taker-in roller of a carding machine, without necessarily cracking the carbide layer, during winding of the card-clothing wire on to the cylinder or taker-in roller.

We claim:

1. A method of producing card-clothing wire for use on a roller in a textile fibre processing machine, comprising providing wire of carbon steel with a longitudinally extending rib and saw teeth projecting therefrom at spaced intervals along the wire; forming the wire into a helical coil having an attitude similar to that it is required to adopt in use when mounted on said roller, with the teeth projecting from the rib in a direction that is substantially radial with respect to the roller on which it is to be mounted, and then subjecting the surface of the coil of wire to a high temperature chromium diffusion process such that a surface layer of the wire is enriched with chromium to an extent which provides the surface of the wire with a hardness in excess of 1500 HV (i.e. 1500 $Kg/mm^2$) as measured on the Vickers hardness scale so that the hard coating is not subjected to bending strains during subsequent application of the wire to the roller.

2. A method of producing card-clothing wire as claimed in claim 1, in which the surface treatment is carried out by use of a gaseous compound of chromium, the wire being subjected to this compound at a temperature in excess of 900° C., so that the chromium vapour combines with the carbon in the steel to produce a chromium carbide surface layer having a very high degree of hardness.

3. Card-clothing wire when made by the method of claim 1.

4. Card-clothing wire made by the method of claim 2.

* * * * *